US006170091B1

(12) United States Patent
Zide et al.

(10) Patent No.: US 6,170,091 B1
(45) Date of Patent: Jan. 9, 2001

(54) METHOD AND APPARATUS INTEGRAL WITH AN ARTICLE OF APPAREL FOR TIGHTENING A STRAP

(75) Inventors: Robert M. Zide, Williamstown; James L. Rector, Vienna, both of WV (US)

(73) Assignee: Proline, Inc., Marietta, OH (US)

( * ) Notice: Under 35 U.S.C. 154(b), the term of this patent shall be extended for 0 days.

(21) Appl. No.: 09/140,746

(22) Filed: Aug. 26, 1998

(51) Int. Cl.[7] ..... A41D 13/00
(52) U.S. Cl. ..... 2/462; 24/171; 24/194
(58) Field of Search ..... 24/171, 194–196, 24/136 R, 25, 115 M; 2/462, 465, 322, 221, 237

(56) References Cited

U.S. PATENT DOCUMENTS

| | | | | |
|---|---|---|---|---|
| 115,654 | | 6/1871 | Stephens . | |
| 130,032 | | 7/1872 | Fautz . | |
| 279,385 | * | 6/1883 | Herkimer | 24/171 X |
| 303,187 | * | 8/1884 | Riesenberg . | |
| 360,369 | | 3/1887 | Buchholz . | |
| 387,398 | | 8/1888 | Corcoran . | |
| 1,639,609 | * | 8/1927 | Hofland | 24/194 |
| 3,814,346 | * | 6/1974 | Carter . | |
| 3,867,726 | | 2/1975 | Owl et al. . | |
| 3,879,810 | * | 4/1975 | Prete, Jr. et al. | 24/194 |
| 4,826,250 | | 5/1989 | Ibanez . | |
| 4,934,030 | * | 6/1990 | Spinosa et al. | 24/194 |
| 5,285,555 | * | 2/1994 | Bell | 24/194 X |
| 5,487,187 | | 1/1996 | Zide et al. . | |

FOREIGN PATENT DOCUMENTS

| | | | | |
|---|---|---|---|---|
| 55850 | | 5/1967 | (DE) . | |
| 2846133 | * | 5/1980 | (DE) | 24/171 |
| 304404 | * | 2/1989 | (EP) . | |
| 19566 | | 10/1895 | (GB) . | |
| 706541 | * | 3/1954 | (GB) | 24/171 |

* cited by examiner

*Primary Examiner*—James R. Brittain
(74) *Attorney, Agent, or Firm*—Birch, Stewart, Kolasch & Birch, LLP

(57) ABSTRACT

A method of securing a strap and a strap fastening apparatus integral with an article of apparel includes an article of apparel and a planar surface. The apparatus further includes a wedge having a handle and a surface with a predetermined angle. The wedge also includes projections which engage with a strap. The apparatus also provides a housing where the wedge is contained within the housing. The apparatus also includes an attachment device where the attachment device fastens the housing to the planar surface. The housing and planar surface form a first opening and a second opening. The apparatus further includes a mechanism for reducing contact area between the strap and the planar surface, whereby translational displacement required for locking the wedge and smoothing wear of the wedge are substantially reduced while friction is substantially increased between the wedge and the strap and between the planar surface and the strap.

32 Claims, 5 Drawing Sheets

METHOD AND APPARATUS INTEGRAL WITH AN ARTICLE OF APPAREL FOR TIGHTENING A STRAP

BACKGROUND OF THE INVENTION

1. Field of the Invention

The present invention generally relates to a fastening apparatus integral with an article of apparel, such as protective shoulder gear which may include shoulder pads which are worn by football players. The fastening apparatus provides infinite tightening adjustment and quick release capability for straps which attach shoulder pads to a user.

2 Description of the Background Art

Various strap fastening systems which are designed for protective shoulder gear currently exist. These systems employ numerous straps which require rather elaborate buckles such as Tee-buckles and slots, clamping rings, and/or buckles with slots which engage with mounting pins. Other prior art systems require specially designed non-elastic straps which include protective padding. Such prior art non-elastic straps become worn and require replacement after each season of use of the protective shoulder gear. For example, in U.S. Pat. No. 5,487,187 (Zide et al.), a two-strap system which employs elaborate clamping rings and non-elastic straps are disclosed. After extended use, the straps in the system become worn and require replacement. Since some of the straps in this prior art system are threaded through a kidney pad, the entire system must be replaced and the user thereby incurs an expense to maintain such a system in an operable condition. With such a complex system that employs Tee-buckles in slots in addition to multiple clamping rings, the complexity of the system makes tightening of the straps of the system more difficult.

In U.S. Pat. No. 3,867,726 (Owl et al.), the strap system provided therein includes readily detachable buckles which engage with pins mounted on front chest portions of a shoulder pad. Such a system is susceptible to accidental disengagement due to impacts and external forces acting on the shoulder pads such as impacts with opposing football players.

Other strap systems coupled to shoulder pads have the disadvantages of requiring relatively complex manipulation for the positioning, tightening, and loosening of the buckles and/or clamping rings which are coupled to the straps. Other systems provide an inconvenient location of the buckle of the strap fastening system which varies with tightness and/or the girth of a user. Systems which employ clamping rings also have the tendency to distort the shape of the straps which in turn lowers the operability and inhibits subsequent free adjustment of the straps. Other buckles in prior art strap fastening systems require attachment to the shoulder pads by secondary flexible straps which are looped through and stitched to a portion of the buckle. Such stitching of a strap to a buckles does not firmly attach the buckle to a shoulder pad which in turn permits the buckle and strap arrangement to become loose and eventually facilitates the disengagement of the buckle and the strap due to the forceful impacts and collisions which occur during use of the shoulder pads.

Various buckles that provide free movement of a strap in one direction and the locking of a strap in the opposite direction currently exist in the prior art. These conventional buckles can include: paired rings that cinch a strap by a wrapping-around-type of engagement with the strap; members which provide cam action that permits clamping of a strap between a cam and a fixed member; or a sliding wedge or roller wedge that clamps a strap in a wedged-shaped housing. For example, in U.S. Pat. No. 360,369 (Buchholz), a sliding wedge that clamps a strap in a wedged-shaped housing is shown. In such a buckle, a roughened or serrated under surface is provided on the sliding wedge. The buckle housing is also secured to the strap itself by prongs which are a part of the housing. Such a design is susceptible to loosening and accidental disengagement since the fastening mechanisms employed do not provide for a rigid attachment. Furthermore, such wedges in the wedge-shaped housing do not increase the coefficient of friction significantly enough to prevent loosening of a strap which is pressed between the wedge and the smooth surface of the housing.

Accordingly, a need in the art exists for a method of securing a strap with a fastening apparatus integral with an article of apparel and a strap-fastening apparatus integral with an article of apparel that locks a strap in a position whereby translational displacement required for locking a wedge of the strap-fastening apparatus and smoothing wear of the wedge are substantially reduced while friction is substantially increased between the wedge and the strap and between a planar surface of the strap-fastening apparatus and the strap.

SUMMARY OF THE INVENTION

Accordingly, it is a primary object of the present invention to provide both a method of securing a strap with a fastening apparatus integral with an article of apparel and a strap-fastening apparatus integral with an article of apparel which locks or secures a strap in a position whereby translational displacement required for locking the wedge and smoothing wear of the wedge are substantially reduced while friction is substantially increased between the wedge and the strap and between the planar surface and the strap.

It is a further object of the present invention to provide a method for fastening a strap and a strap-fastening apparatus which is integral with an article of apparel where the article of apparel forms the planar surface which contacts one side of a strap while a wedge of the fastening apparatus contacts another side of the strap.

Another object of the present invention is to provide a method of securing a strap with a fastening apparatus integral with an article of apparel and a strap-fastening apparatus integral with an article of apparel wherein the strap-fastening apparatus includes a base plate which has a planar surface that contacts one side of a strap while a wedge of the strap-fastening apparatus contacts the opposing side of the strap.

Another object of the present invention is to provide a method of securing a strap with a fastening apparatus integral with an article of apparel and a strap-fastening apparatus integral with the article of apparel which include a wedge with pre-determined projections that engage with a strap and means for reducing contact area between the strap and the planar surface of the fastening apparatus.

It is further an object of the present invention to provide a method of securing a strap with a fastening apparatus integral with an article of apparel and a strap-fastening apparatus integral with an article of apparel where the article of apparel includes protective shoulder gear while the planar surface for the strap-fastening apparatus can either be a separate base plate or part of protective shoulder gear.

It is another object of the present invention to provide a strap-fastening apparatus integral with an article of apparel which requires relatively simple manipulation for positioning, tightening, and loosening of the buckle strap arrangement.

Another object of the present invention is to provide a convenient location of a strap-fastening apparatus that does not change with tightness of a strap and which does not distort the shape of the strap therein.

Another object of the present invention is to reduce the number of straps required to secure an article of apparel such as protective shoulder gear.

An additional object of this invention is to provide a strap-fastening apparatus which includes low-profile buckles that have properties of automatic cinching of the strap after infinite manual tightening adjustment, and to provide for rapid loosening of a strap.

An additional object of the present invention is to provide convenient locations for the buckles of the strap-fastening apparatus which facilitate a user's access to the apparatus, regardless of tightening and adjustment of the straps.

A further object of the present invention is to provide a strap-fastening apparatus which is relatively easy to replace and which is easily reconditioned at minimal or low cost.

A further object of the present invention is to provide a fastening apparatus integral with an article of apparel which employs standard sizes for the fastening mechanisms which attach the housing of the fastening apparatus to the article of apparel so that conventional mounting hardware can be used as replacement parts for the strap fastening apparatus.

A further object of the present invention is to provide a strap-fastening apparatus integral with an article of apparel which includes a low-profile and relatively thin sliding wedge which is capable of mass production by simple injection molding techniques.

Another object of the present invention is to provide is to provide a strap-fastening apparatus integral with an article of apparel that includes a wedge having projections of a predetermined shape and a planar surface having means producing contact area between the strap and the planar surface, whereby the coefficient friction is substantially increased.

A further object of the present invention is to provide a strap-fastening apparatus which includes a housing having shaped portions to partially route a strap around an end of the wedge, and a wedge having projections of a predetermined shape to cause immediate and automatic cinching after releasing a tightened strap. It is a further object of the present invention to provide a strap-fastening apparatus which includes a wedge having projections with a predetermined shape which substantially prevents the accumulation of dirt, mud, or other external environmental elements which could degrade the fastening of a strap while the projections can provide additional friction with a strap by penetrating between fibers and strands of a typical webbing weave of a strap.

Another object of the present invention is to provide a strap-fastening apparatus with a wedge having projections of a predetermined shape and which are disposed at a predetermined angle to significantly reduce smoothing wear of the wedge in addition to providing adequate penetration between strands of a webbing of a strap.

A further object of the present invention is to provide a strap-fastening apparatus with a wedge and a housing with a predetermined angle which promote structural integrity of the strap-fastening apparatus while significantly reducing the translational displacement required for locking of the wedge.

An additional object of the present invention is to provide a strap-fastening apparatus where the coefficient of friction between the strap and the wedge is substantially increased.

Another object of the present invention is to provide a strap-fastening apparatus which wraps a strap around an end of the wedge and urges the wedge into re-engagement when the strap is released by the user.

These and other objects of the present invention are fulfilled by providing a method of securing a strap with a fastening apparatus integral with an article of apparel, the method comprising the steps of: providing an article of apparel; providing a roughened surface; providing a wedge having a predetermined angle with a handle mechanism, the wedge including an angled surface with projections; providing a housing; placing the wedge adjacent to the housing; attaching the housing to the roughened surface while forming a first opening and a second opening with the housing and the roughened surface; moving a strap in a first-referenced direction through the first opening between the wedge and the roughened surface while maintaining structural integrity of the housing and the roughened surface; engaging one side of the strap with projections of the wedge while engaging another side of the strap with the roughened surface; moving the strap out of the second opening; moving the wedge in a second referenced direction; and locking the wedge against at least one of the straps, the housing, and the roughened surface, whereby translational displacement required for locking the wedge and smoothing wear of the wedge are substantially reduced while friction is substantially increased between the wedge and the strap and between the roughened surface and the strap.

Moreover, these and other objects of the present invention are fulfilled by a strap-fastening apparatus integral with an article of apparel comprising: an article of apparel; a planar surface; a wedge having a handle and a surface with a predetermined angle, the wedge further including projections which engage with a strap; a housing; a wedge being contained within the housing; an attachment device, the attachment device fastening the housing to the planar surface, the housing in the planar surface forming a first opening and second opening; and means for reducing contact area between the strap and the planar surface, whereby translational displacement required for locking the wedge and smoothing wear of the wedge are substantially reduced while friction is substantially increased between the wedge of the strap and between the planar surface and the strap.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
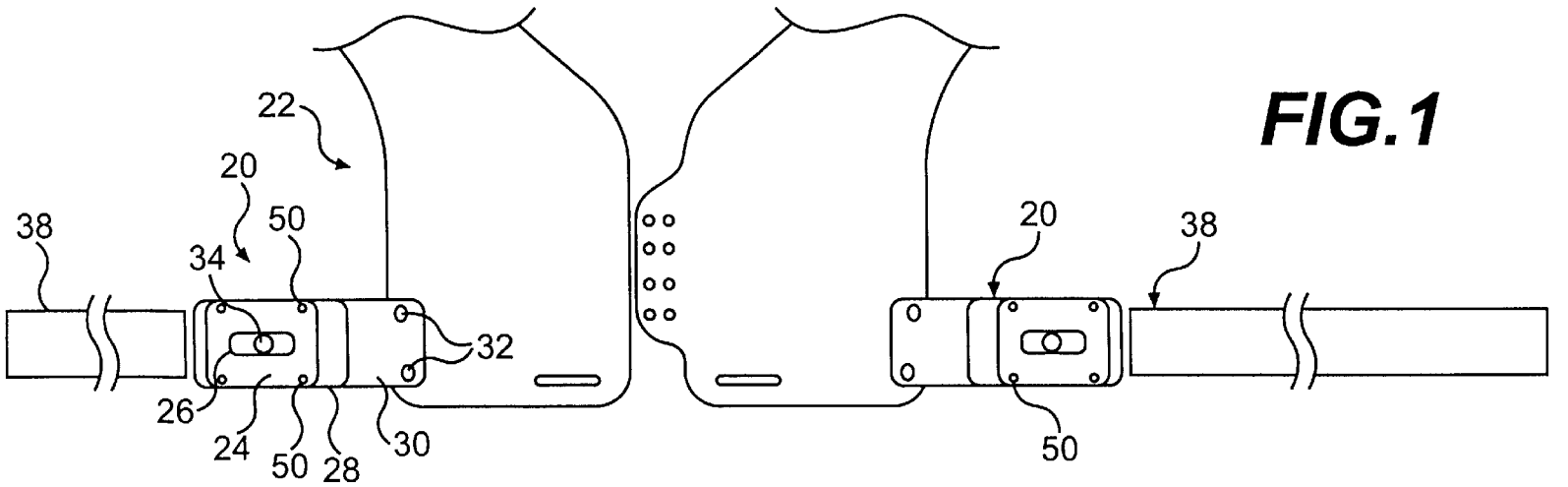
FIG. 1 is a front view of a first embodiment of the strap-fastening apparatus integral with an article of apparel.

Referring in detail to the drawings and with particular reference to FIG. 1, the strap-fastening apparatus 20 integral with an article of apparel 22, is shown. The strap-fastening apparatus 20 includes a housing 24 having an aperture 26. The article of apparel 22 is, for example, protective shoulder gear which includes shoulder pads. However, other articles of apparel are not beyond the scope of the present invention. Also, while the article shown can be used as football shoulder pads, the concepts of the present invention are also applicable to protective padding for other sports. For example, the strap-fastening apparatus 20 can be used with many types of articles of apparel such as helmets/headpieces, protective arm wear (such as elbow pads), protective leg wear (such as knee pads), and other articles of apparel which require secure fastening to a user while providing means for a quick release thereof. It is contemplated that the article of apparel 22 of the present invention will include protective shoulder gear such as shoulder pads which will be used by a football player. While sports apparel has been discussed, the present invention can also be applied to bullet-proof vest and other types of protective clothing as well as everyday apparel, such as vests.

As seen in FIG. 1, the strap-fastening apparatus 20 comprises a housing 24 which is designed to be permanently attached to the base plate 28 and the support strap 30. The support strap 30 is preferably designed to be permanently fixed to the article of apparel 22. This support strap 30 is preferably attached to the article of apparel 22 by means of rivets which have a diameter which is equivalent to the diameter of conventional T-nuts used in the conventional art. Providing rivets with such a diameter permits replacement of the rivets with conventional T-nuts so that replacement costs for reconditioning the strap-fastening apparatus of the present invention after normal use will be substantially decreased.

The support strap 30 is preferably BIOTHANE (plastic) coated webbing which is 60 mm wide and 140 mm long, however, the support strap 30 of the first embodiment of the present invention is not limited to the dimensions and the materials of biothane coated webbing. Other materials include, but are not limited to, nylon webbing, leather, metallic plastic-coated straps, elastomers (rubber), and other like materials. The strap-fastening apparatus 20 further includes a handle 34 which is coupled to a wedge 36 (See FIG. 3C). The attachment devices for the support strap 30 are not limited to rivets 32 and can include other types of fastening devices. Other types of fastening devices include, but are not limited to, nuts and bolts, sheet metal screws, adhesives such as glue, welds, and other like attachment devices.

Figure 2A:
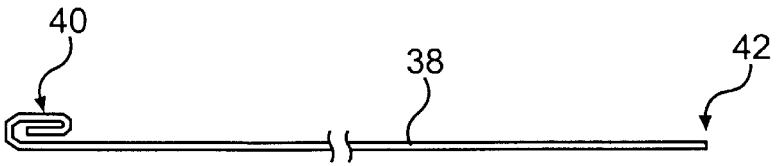
FIG. 2A is a side view of a strap used in the present invention.

The fastening strap 38 which is used to secure the article of apparel 22 to a user is shown in FIG. 2A. The strap 38 is preferably made of nylon webbing which is 1½ inches wide and 35 inches in length. The strap includes a rolled and stitched end 40 which prevents the strap 38 from becoming separated from the strap-fastening apparatus 20 after loosening thereof. The strap 38 also preferably includes heat-sealed ends 42. The rolled and stitched end 40 substantially prevents inadvertent disengagement of the strap 38 on the strap-fastening apparatus during loosening thereof. One end 42 of the strap 38 opposite to the rolled and stitched end 40 is attached to the article of apparel 22 by conventional mechanisms (not shown). For a shoulder pad article of apparel, the end 42 in FIGS. 2A and 2B opposite to the rolled and stitched end 40 is attached to a rear arch of the shoulder pad by rivets or a conventional buckle.

The strap 38 is not limited to the materials of nylon. Other materials include, but are not limited to, nylon webbing, leather, metallic plastic-coated straps, elastomers (rubber), and other like materials. While the strap 38 is preferably rectangular in cross-section, other strap geometries and other types of straps are not beyond the scope of the present invention. Other types of straps and strap geometries include, but are not limited to, string-like cord materials which have a circular cross-section; plastic coated metallic straps; and other like materials and shapes. The straps of the present invention can include any materials which are suitable with the strap-fastening apparatus 20 which encloses the housing 24 in the wedge 36.

Figure 2C:
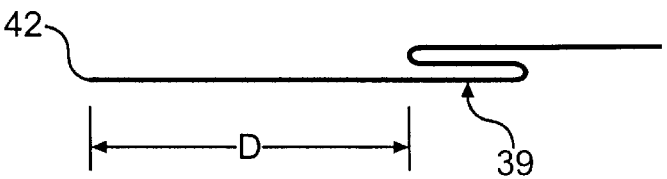
FIG. 2C is a side view of another strap used in the present invention.
Figure 2B:
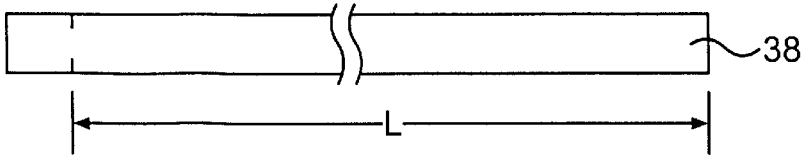
FIG. 2B is an elevational view of a strap used in the present invention.

In FIG. 2C, the strap 38 includes a stitched loop 39 spaced at a distance D from one of the heat sealed ends 42 of the strap 38 so that the one heat sealed end 42 of the strap 38 is easily grasped by the user when the strap 38 is disposed within the strap fastening apparatus 20. The distance D is preferably 50 mm so that the strap 38 always protrudes from the strap fastening apparatus 20. While 50 mm is the preferred distance D, other spacing values are not beyond the scope of the present invention as long as enough spacing exists between the end 42 and the stitched loop 39 so that a user can grasp the strap 38 while the strap is disposed within the strap fastening apparatus 20.

Figure 3A:
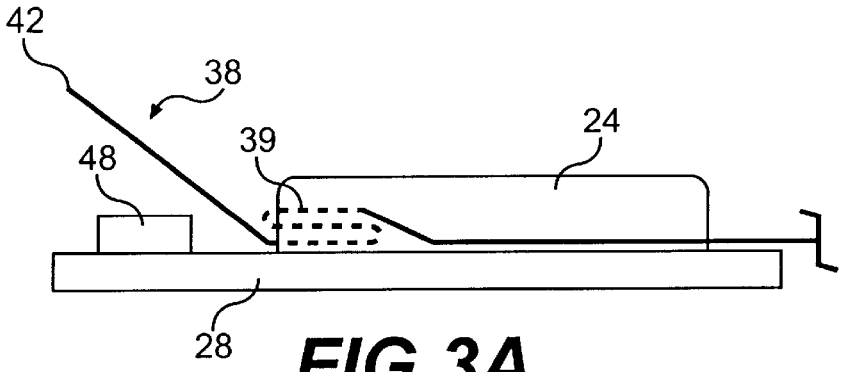
FIG. 3A is a side view of the strap shown in FIG. 2C which is disposed in the strap fastening apparatus of the present invention.

In FIG. 3A, a loosened state of the strap 38 is shown. In this loosened state, the loop 39 is disposed within the housing 24 to prevent the strap 38 from being removed completely from the housing 24. With the loop 39 preventing the strap 38 from being entirely removed from the housing 24, the end 42 is readily available for a user to grasp in order to tighten the strap 38, which would cause the loop 39 to be moved out of the housing 24. The loop 39 functions as a stopping device. However, the present invention is not limited to loop 39. Other stopping devices include, but are not limited to, buckles, fasteners, and other like projections which would prevent the strap 38 from being removed from the housing 24 when the strap 38 is in a loosened state.

Figure 3B:
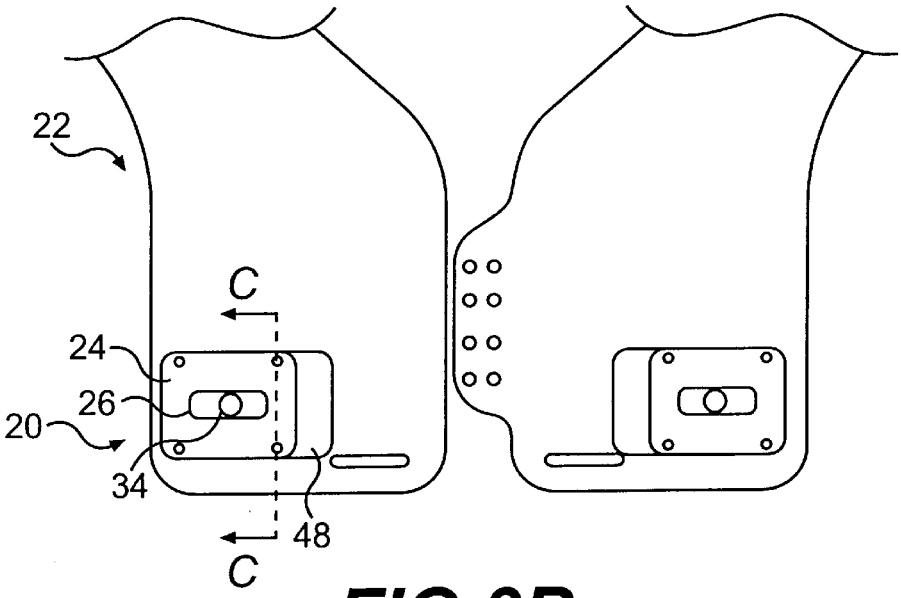
FIG. 3B is a front view of a second embodiment of the strap-fastening apparatus integral with an article of apparel.

The second embodiment of the present invention is shown in FIG. 3B. In this embodiment, the housing 24 is directly mounted to the article of apparel 22. The article of apparel 22 in this embodiment includes a planar surface 44 which includes means 46 for reducing contact area between the strap 38 and the planar surface 44.

In the second embodiment of FIG. 3B, the article of apparel forms a bulge portion 48 which is disposed adjacent to the housing 24. The bulge portion 48 elevates the strap 38 when one end of the strap 38 projects through an opening on the side of the housing 24 and article of apparel 22.

Figure 3C:
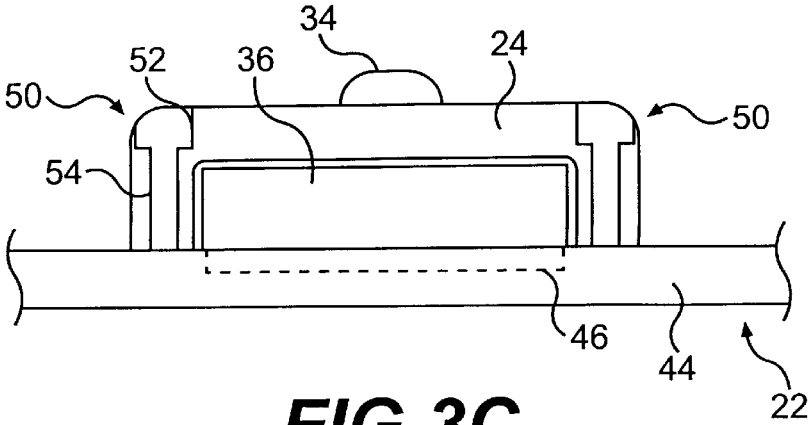
FIG. 3C is a cross-sectional view of the housing and article of apparel of the second embodiment of the present invention along the cut line of letters C—C of FIG. 3A.

FIG. 3C further shows the details of apertures 50 which are used by attachment devices. Apertures 50 include a counter bore section 52 and a regular bore section 54. The attachment devices which are placed in the apertures 50 are preferably rivets. However, other attachment devices are not beyond the scope of the present invention. Other attachment devices include, but are not limited to, screw fasteners, nut and bolt fasteners, adhesives, welds, and other like attachment devices. As seen in FIG. 3C, the cross-section of the housing 24 has been shaded to indicate that the housing 24 is made of a resin or plastic material. Preferably, the housing material is to be made from stiff injection molded plastic, such as acetyl. However, the housing 24 is not limited to this material and may include other materials such as nylon. Other materials which are not beyond the scope of the present invention include, but are not limited to, ferrous alloys, such as stainless steel or cast iron, non-ferrous alloys which include copper and titanium, ceramic materials, polymers which include thermoplastics and elastomers, and composite materials, and other like materials.

Further details of the means 46 for reducing contact area between the strap 38 and the planar surface 44 will be discussed infra with respect to FIGS. 11 through 13.

In the preferred embodiment of the present invention, the article of apparel 22 is preferably protective shoulder gear which includes shoulder pads. The shoulder pads are preferably formed with a plastic material having suitable flexibility yet possessing sufficient rigidity to withstand shocks or substantial force.

The location and types of apertures 50 which are used with the attachment devices are not limited to the locations and sizes provided in the FIG.s. The sizes and locations of the apertures 50 can be adjusted according to the automated manufacturing process and/or depending upon the type of attachment devices employed.

Figure 4:
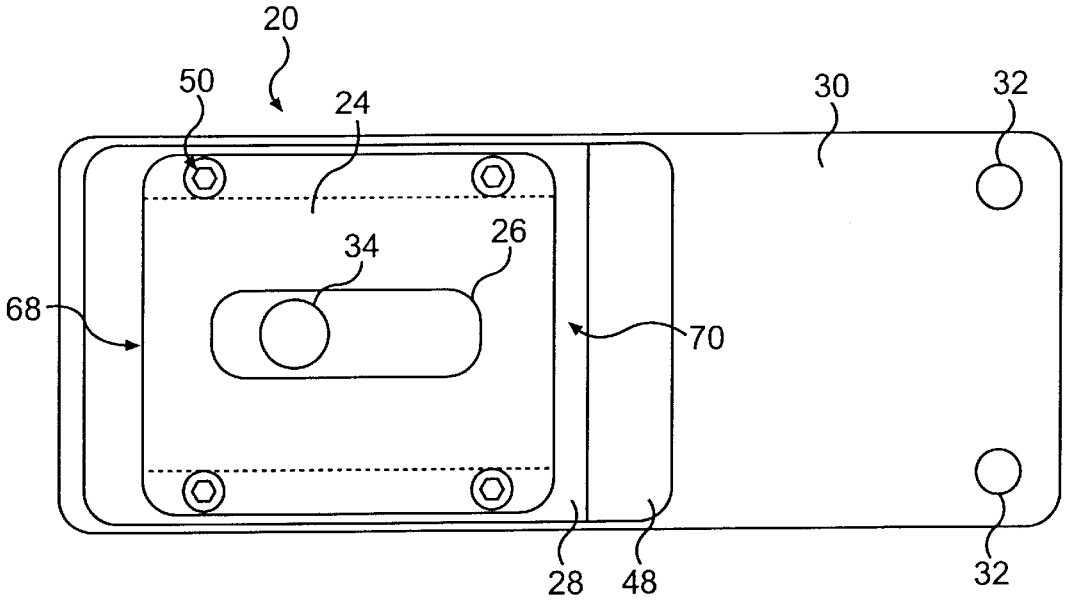
FIG. 4 is an elevational view of the first embodiment of the strap-fastening apparatus integral with an article of apparel.

In FIG. 4, an enlarged elevational view of the strap-fastening apparatus 20 of the first embodiment is shown. Similar to the strap-fastening apparatus 20 of the second embodiment, the strap-fastening apparatus 20 of the first embodiment further includes a bulge portion 48 which is part of the base plate 28.

As seen in FIG. 4, the aperture 26 is preferably elliptical in shape, however, other shapes are not beyond the scope of the present invention. Other shapes include, but are not limited to, circular, rectangular, square, and other like polygonal or curved shapes.

Figure 5:
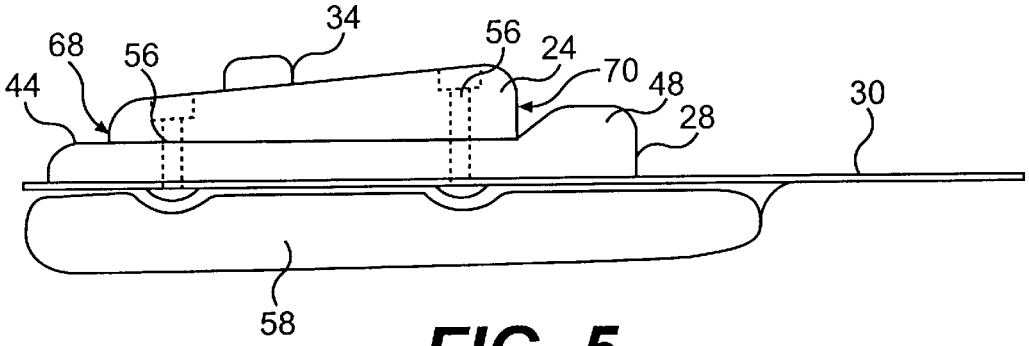
FIG. 5, is a side view of the first embodiment of the strap-fastening apparatus integral with an article of apparel.

Attachment devices 56 are shown in further detail in FIG. 5. As noted above, attachment devices 56 preferably include rivets. The attachment devices 56 penetrate through the support strap 30, the base plate 28, and the housing 24. In this first embodiment of the present invention, a strap-fastening apparatus 20 further includes means 58 for absorbing shocks or impacts to the strap-fastening apparatus 20. The means 58 for absorbing shocks or impacts preferably includes a foam pad which is preferably 15 mm thick. The shock absorbing means 58 is preferably stitched in fabric and stitched to support strap 30. Other fastening methods for attaching the shock absorbing means 58 to the support strap 30 are not beyond the scope of the present invention. Other fastening methods or mechanisms include, but are not limited to, adhesives, rivets, nut and bolt fasteners, and other like fastening mechanisms. The shock absorbing means 58 is not limited to foam padding and can include other materials such as rubber, plastic mixtures, or other like shock absorbing materials. It is contemplated that the shock absorbing means 58 will protect a user from side impacts such as in the preferred embodiment of the present invention where a strap-fastening apparatus 20 is employed with football protective shoulder gear.

In FIG. 5, the housing 24 and the base plate 28 form a first opening 68 in which an end of the strap 38 is fed therethrough. The housing 24 and the planar surface 44 of the base plate 28 further provide a second opening 70 which permits an end of the strap 38 to penetrate therethrough. In the second embodiment of the invention shown in FIGS. 3A and 3B, the planar surface 44 of the article of apparel 22 and the housing 24 form similar first and second openings for the strap 38.

Figure 6:
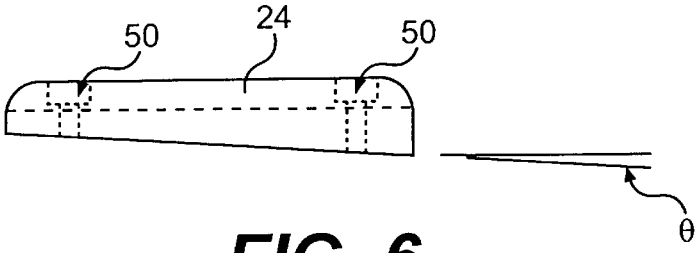
FIG. 6 is a side view of a housing a the present invention.

FIG. 6 shows a side view of the housing 24 which has a predetermined angle theta (θ). A predetermined angle theta (θ) is approximately equal to the predetermined angle of the wedge 36 (not shown). The predetermined angle is measured with respect to the planar surface 44 (not shown). Further details of the predetermined angle theta (θ) will be discussed infra with respect to FIGS. 7–10. The housing 24 is generic to the first and second embodiments of the present invention.

Figure 8:
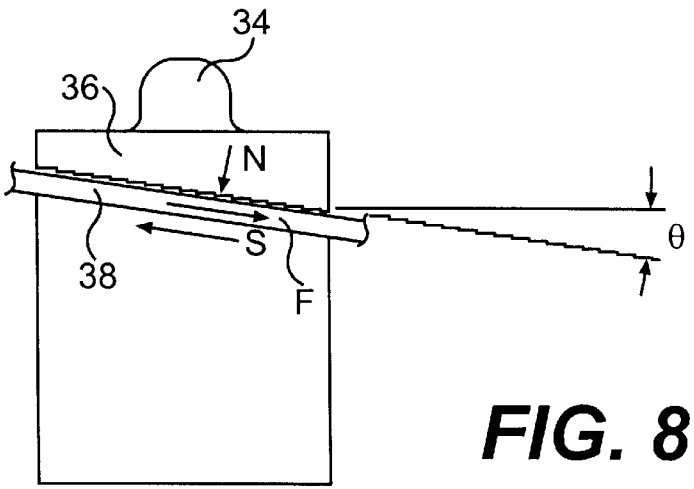
FIG. 8 is a side view of the wedge of the present invention.
Figure 7:
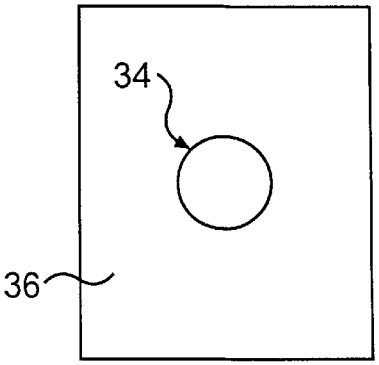
FIG. 7 is a plan the wedge of the present invention.

FIGS. 7–10 provide further details of the wedge 36. FIG. 7 shows an elevational view of the wedge 36 while FIG. 8 shows a side-view of the wedge 36. The handle 34 and the wedge 36 are preferably a unitary structure which is formed by an injection-molding process. As noted above, the preferred materials of the wedge 36 and handle 34 are preferably acetyl or nylon. However, other materials are not beyond the scope of the present invention. Other materials include, but are not limited to, ferrous alloys, non-ferrous alloys, ceramic materials, other types of polymers, composite materials, and other like materials.

The predetermined angle theta (θ) of the wedge 36 which is approximately equal to a predetermined angle theta (θ) of the housing 24 is determined according to the following equation:

Ratio of the forces which are normal with the contacting surfaces to the pull force =1/tangent (θ)

The properties of friction are important for the design of the strap-fastening apparatus 20 of the present invention. Frictional forces act on mating surfaces in contact and have a direction which is tangent or parallel to the surfaces in contact. For example, as shown in FIG. 8, a normal force N is exerted by the wedge 36 on the strap 38 and the frictional force F exists between the strap 38 and the wedge 36 and opposes pulling forces S which are exerted on strap 38. The magnitude of the frictional force F is the product of the normal force N which is perpendicular to the mating surfaces of the strap 38 and wedge 36) and the coefficient of friction (which is typically based on empirical data derived from tests of the specific materials and contact). The sliding wedge 36 converts the strap pull force S into the normal force N which is proportional to the reciprocal of the tangent to the predetermined angle theta (θ). The coefficient of friction for smooth plastic such as used in the strap 38 and the wedge 36 may vary from 0.05 to 0.25. In order to ensure that the wedge 36 will be self-locking, the tangent of the predetermined wedge angle theta (θ) must be smaller than the lowest coefficient of friction.

Due to the coefficient of friction for the materials of the present invention, small wedge angles are necessary to ensure self-locking of the wedge 36 with respect to the strap 38. However, two disadvantages are apparent with very small wedge angles: (1) internal forces in the strap-fastening apparatus may become very high, jeopardizing structural integrity of the apparatus, and (2) when the strap 38 is tightened and released, the wedge 36 must slide a relatively large distance before locking. In the present invention, 7° was chosen for the predetermined wedge angle theta (θ) in order to avoid these disadvantages. However, other predetermined wedge angles ranging from 3 to 10° are also feasible for the present invention. While the preferred embodiment of the present invention includes a wedge 36 and handle 34 which are formed of a unitary structure, it is possible to employ a wedge 36 and a handle 34 which are manufactured separately. For example, a metallic pin or screw could be employed as a handle which penetrates into a plastic wedge 36.

Figure 10:
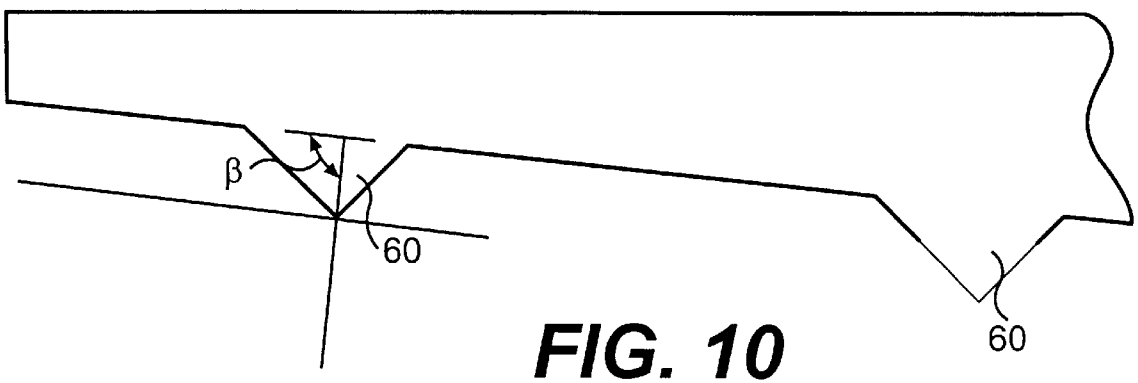
FIG. 10 is an enlarged side view of the wedge of the present invention.
Figure 9:
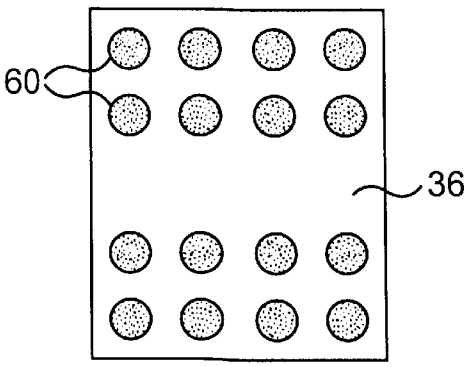
FIG. 9 is a bottom view of a wedge of the present invention.

As seen in FIGS. 9 and 10, projections 60 are provided on a web contacting surface of the wedge 36. These projections 60 also substantially reduce the effects of the accumulation of dirt, mud, and other external environmental elements which are present during the use of the strap-fastening apparatus 20 that could reduce friction. The projections 60 substantially reduce the smoothing wear of wedge 36 which occurs due to repeated use and substantially increases friction between the strap 38 and wedge 36 by penetrating through at least one of fibers and strands present in the strap 38.

The projections 60 are preferably shaped as cones which have a predetermined angle beta (β). However, other types of projections are not beyond the scope of the invention. The projections 60 can also include stepped ridges and other like projecting structures. The shape of the projection 60 is not limited to cone shapes and may include other shapes such as pentagonal, tetrahedral, rectangular, frustroconical, and other like shapes. The angle beta (β) of the cone projections 60 of the present invention is preferably 90°. However, other angles of the projections can include angles ranging from 60 to 120°. Tests of prototypes of the wedge 36 and housing 24 having a predetermined angle theta (θ) of 7° and having projections with predetermined angles beta (β) of 90° indicate that such structures work not only well with polypropylene webbing, but also nylon webbing of straps 38 even if the straps are of the relatively thin gage. Nylon has a lower coefficient of friction than polypropylene, but is preferred for resistance to fraying and resistance to a dirt accumulation. With the wedge 36 having a predetermined angle theta (θ) in addition to projections 60 with predetermined angles beta (β) and where the wedge is disposed within a housing 24 having a predetermined angle theta (θ), this configuration urges the strap 38 around the ends of the wedge 36 in addition to urging the wedge 36 into re-engagement when the strap pulling force S is substantially reduced or eliminated.

As seen in FIG. 9, the projections 60 are disposed in rows and columns to provide a symmetrical distribution of projections 60 which evenly distribute the normal forces and being produced by the combination of the wedge 36 and housing 24. While the preferred embodiment of the present invention is to include projections 60 on the wedge 36 with a uniform distribution, asymmetrical distributions or random arrangements of the projections 60 are not beyond the scope of the present invention. With the predetermined wedge angle theta (θ) of the wedge 36 and the predetermined angle theta (θ) of the housing 24, the translational displacement for locking the wedge 36 is substantially reduced. In the preferred embodiment of the present invention, the symmetrical distribution of the projection 60 includes four quadrants disposed on the wedge 36 where each quadrant includes at least four projections 60.

Figure 13:
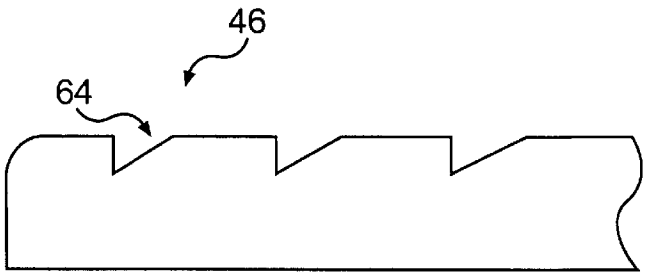
FIG. 13 is an enlarged side view of the planar surface in the first embodiment of the present invention.
Figure 11:
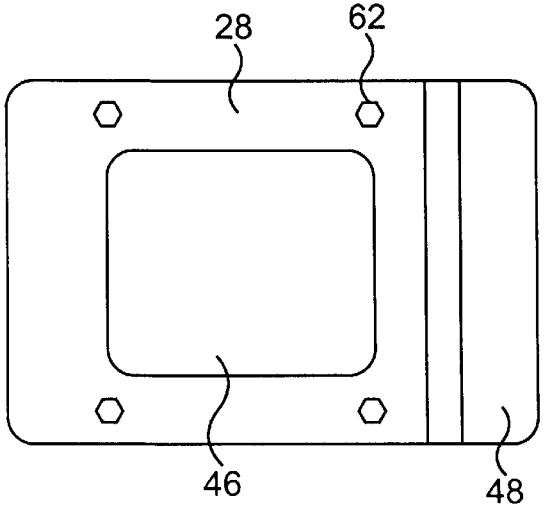
FIG. 11 is an elevational view of the planar surface in the first embodiment of the present invention.
Figure 12:
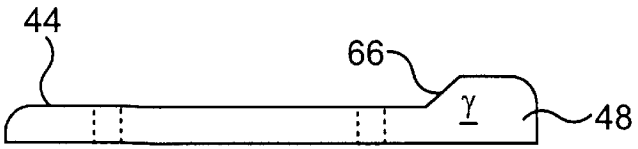
FIG. 12 is a side view of the planar surface in the first embodiment of the present invention.

Further structural details of the base plate 28 are shown in FIGS. 11–13. The base plate 28 includes a planar surface 44 which is substantially similar to the planar surface 44 on the article of apparel 22 in FIG. 3B. The base plate 28 further includes apertures 62 which are substantially aligned with the apertures 50 within the housing 24 to permit attachment devices 56 to penetrate therethrough. Similar to the planar surface 44 of the article of apparel 22, the base plate 28 can further include means 46 for reducing contact area between the strap 38 and the planar surface 44. The means 46 for reducing contact area preferably includes at least one of sand-blasted surface discontinuities and grooves 64 (See FIG. 13). However, a base plate without having contact area reducing means where the base plate is substantially smooth is not beyond the scope of the present invention.

The means 46 for reducing contact area between the strap 38 and the planar surface 44 is not limited to sand-blasted discontinuities and grooves 64. Other mechanisms for reducing contact area include, but are not limited to, holes, slits, and other like contact reducing mechanisms. The contact area reducing means 46 is provided for the following reasons: normally, an area in contact does not affect the magnitude of the frictional force. However, when contact pressure becomes relatively high, such as occurs with very small areas in contact, the magnitude of friction also becomes disproportionally high. Very small contact areas increase the coefficient of friction. Accordingly, the contact area of reducing means 46 was provided on the planar surfaces 44 in each of the embodiments of the present invention in order to increase the coefficient of friction between the strap 38 and the planar surface 44.

FIG. 12 further shows details of the bulge portion 48 which is formed by the base plate 28. A bulge portion 48 is also formed by the article of apparel 22 in FIG. 3B of the second embodiment. The bulge portion 48 ensures that the strap 38 is wrapped around an edge of the wedge 36 (not shown). The bulge portion 48 includes a side 66 with a predetermined angle gamma (γ). The predetermined angle gamma (γ) is preferably 45° in order to urge the strap 38 around an end of the wedge 36. However, other angles are not beyond the scope of the present invention. Other angles include any angle which causes the bulge portion 48 to urge the strap 38 against an end of the wedge 36. The bulge portion 48 is not limited to a portion formed by the base plate 28. The bulge portion 48 may be formed by a separate member attached to the base plate 28 by an attachment device such as rivets or screws as shown in FIG. 3A.

Figure 14:
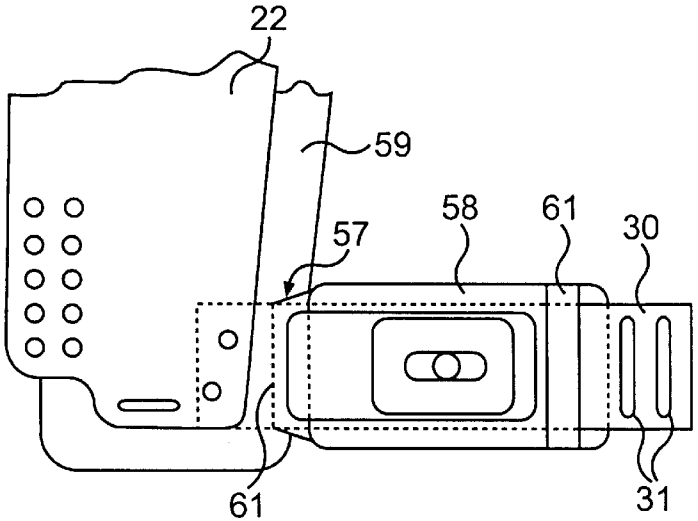
FIG. 14 is an elevational view of another embodiment of the shock absorbing means of the present invention.

FIG. 14 shows another embodiment of the present invention where the shock absorbing means or foam pad 58 has a width dimension which is substantially larger than a width dimension of the support strap 30. The foam pad 58 is preferably positioned along the support strap 30 so that it does not overlap a strip pad 59 which is disposed on the article of apparel 22. In this embodiment, excess fabric 57 disposed around the foam pad 58 is provided to secure the pad 58 to the support strap 30. The fabric 57 is attached to the strap by a fastening mechanism 61 such as sewn thread. However, other fastening mechanisms which attach the fabric 57 to the support strap 30 are not beyond the scope of the present invention. Other fastening devices include, but are not limited to, screw fasteners, rivets, adhesives, and other like fastening devices. The pad 58 in this embodiment further includes a loop 63 which is stitched to the fabric surrounding the pad 58 to keep the pad aligned in a parallel manner with at least one of the support strap 30 and fastening strap 38. The loop 63 prevents the pad 58 from twisting and turning while the pad 48 is positioned adjacent to the support strap 30 and adjacent to the user. The strap 30 in this embodiment further includes apertures 31, through in which the fastening strap 38 penetrates. The apertures 31 substantially align the support strap 30 in a parallel manner with the fastening strap 38.

The present invention also provides a method of securing a strap with a fastening apparatus integral with an article of apparel. This includes the steps of providing an article of apparel 22 and providing a roughened surface 46. A wedge 36 having a predetermined angle theta (θ) with a handle mechanism 34 is provided adjacent to a housing 24. The wedge 36 is provided with an angled surface with projections 60.

The housing 24 is attached to the roughened surface while forming a first opening 68 and a second opening 70 with the housing 24 and roughened surface 46. Then, a strap 38 is moved in a first reference direction through the first opening 68 between the wedge 36 and the roughened surface 46 while maintaining structural integrity of the housing 24 and the roughened surface 46.

One side of the strap 38 is engaged with projections 60 of the wedge 36 while another side of the strap 38 is engaged with the roughened surface 46. The strap 38 is then moved through and out of the second opening 70. The wedge 36 is then moved in a in a second reference direction which is opposite to the first reference direction.

The wedge 36 is then locked against at least one of the strap 38, the housing 24, and the roughened surface 46, whereby translational displacement required for locking the wedge 36 and smoothing wear of the wedge 36 are substantially reduced while friction is substantially increased between the wedge 36 and the strap 38 and between the roughened surface 46 and the strap 38.

The method includes the step of providing a roughened surface 46 which includes providing depressions which are at least one of sandblasted discontinuities and grooves 64 on the article of apparel 22.

The method also includes the step of providing an article of apparel 22 which includes protective body armor. The invention also provides a step of shaping the wedge 36 with a predetermined angle theta (θ) which is between 3 and 10° (degrees) relative to the roughened surface 46. The method also includes a step of shaping the wedge 36 with an angle (θ) that is substantially seven degrees.

With the method, a roughened surface 46 is provided with depressions which are at least one of sandblasted discontinuities and grooves 64. The method also includes providing a wedge 36 with conical projections 60 on a strap contacting surface of the wedge 36. The method further includes the step of shaping the conical projections 60 with an angle beta (β) between 60 and 180 degrees relative to a strap contacting surface of the wedge 36. The method also includes the step of shaping the conical projections 60 with an angle beta (β) of substantially 90 degrees relative to a strap contacting surface of the wedge.

The method also includes the step of penetrating between at least one of fibers and strands of the strap 38 with the conical projections 60 and aligning the conical projections 60 in rows and columns to form a multiaxis symmetrical distribution.

With the method, the strap 38 is denoted as a first strap and includes the steps of attaching a cushion member 58 to the roughened surface 46 on a side opposite to the housing 24 and attaching a second strap 30 to the roughened surface 46 on a side opposite to the housing 24 between the cushion member 30 and the housing 24. The method also provides for the riveting the housing 24 to the roughened surface 46 while providing a bulge portion 48 on the roughened surface 46 adjacent to the second opening 70. The method also provides for projecting the handle 34 of the wedge 36 through a slot 26 in the housing 24.

With the above method and fastening apparatus integral with an article of apparel, translational displacement required for locking the wedge 36 and smoothing wear of the wedge 36 are substantially reduced while friction is substantially increased between the wedge 36 and the strap 38 and between the planar surface 44 and the strap 38.

The present invention provides a method for fastening a strap 38 and a strap-fastening apparatus 20 which is integral with an article of apparel 22 where the article of apparel 22 forms the planar surface 44 which contacts one side of a strap 38 while a wedge 36 of the fastening apparatus 20 contacts another side of the strap 38.

With the invention, method of securing a strap 38 with a fastening apparatus 20 integral with an article of apparel 22 and a strap-fastening apparatus 20 integral with an article of apparel 22 is provided wherein the strap-fastening apparatus 20 includes a base plate 28 which has a planar surface 44 that contacts one side of a strap 38 while a wedge 36 of the strap-fastening apparatus 20 contacts the opposing side of the strap 38. The present invention provides a wedge 36 with predetermined angled projections 60 that engage with a strap 38 while a planar surface 44 includes means 46 for reducing contact area between the strap 38 and the planar surface 44 of the fastening apparatus 20.

The present invention provides an article of apparel 22 which includes protective shoulder gear while the planar surface 44 for the strap-fastening apparatus can either be a separate base plate 28 or part of protective shoulder gear 22. The invention also provides a strap fastening apparatus 20 which requires relatively simple manipulation for positioning, tightening, and loosening of the buckle strap arrangement.

With present invention, a convenient location of a strap-fastening apparatus 20 is provided that does not vary with tightness of a strap 38 and which does not distort the shape of the strap 38 therein. The present invention reduces the number of straps required to secure an article of apparel 22 such as protective shoulder gear to a user.

The present invention provides a strap-fastening apparatus which includes low-profile buckles that have properties of automatic cinching after infinite manual tightening adjustment, and provide for rapid loosening of a strap.

The present invention provides convenient locations for the buckle of the strap-fastening apparatus 20 and facilitates a user's access regardless of tightening and adjustment of the strap-fastening apparatus 20. The present invention provides a strap-fastening apparatus 20 which is relatively easy to replace and which is easily reconditioned at minimal or low cost. The invention provides a strap fastening apparatus which employs standard sizes for the fastening mechanisms 32 which attach the housing of the fastening apparatus to the article of apparel 22 so that conventional mounting hardware can be used as replacement parts for the strap fastening apparatus 20.

The present invention provides a strap-fastening apparatus 20 integral with an article of apparel 22 which includes a low-profile and relatively thin sliding wedge 36 which is capable of mass production by simple injection molding techniques. With the present invention, a strap-fastening apparatus 20 integral with an article of apparel 22 that includes a wedge 36 having projections 60 of a predetermined shape and a planar surface 44 having means 46 for reducing contact area between the strap 38 and the planar surface 44, which substantially increases the coefficient friction.

The invention provides a base 28 having shaped or bulge portions 48 which partially route a strap 38 around an end of the wedge 36, and the wedge 36 having projections 60 of a predetermined shape which cause immediate and automatic cinching of the strap 38 after release of the strap 38. The invention provides a wedge 36 having projections 60 with a predetermined shape which substantially prevent adverse effects of the accumulation of dirt, mud, or other external environmental elements which could degrade the fastening of a strap 38 while the projections provide additional friction with the strap 38 by penetrating between fibers and strands of a typical webbing weave of the strap 38.

The present invention provides a strap-fastening apparatus 20 with a wedge 36 having projections 60 of a predetermined shape and which are disposed at a predetermined angle beta ($\beta$) to significantly reduce smoothing wear of the wedge 36 in addition to providing adequate penetration between strands of a webbing of a strap 38.

The invention provides a strap-fastening which promotes structural integrity of the strap-fastening apparatus 20 while significantly reducing the translational displacement required for locking of the wedge 36.

The present invention provides a strap-fastening apparatus 20 which substantially increases the coefficient of friction between the strap 38 and the wedge 36. The invention also provides a strap-fastening apparatus 20 which wraps a strap 38 around an end of the wedge 36 and urges the wedge 36 into re-engagement when the strap 36 is released by a user.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

What is claimed is:

1. An apparatus comprising:

an article of apparel in the form of a protective shoulder pad;

a strap attached to said shoulder pad;

a substantially planar surface overlying said shoulder pad;

a housing overlying said substantially planar surface and forming a first opening between said substantially planar surface and said housing and a second opening between said substantially planar surface and said housing;

a wedge contained within said housing, said wedge including a first surface and a second surface arranged at a predetermined angle relative to one another;

a handle associated with said wedge for allowing said wedge to be manually moved in a first direction; and an engagement surface formed on said second surface for engaging with said strap, wherein said strap passes through said first opening, between said engagement surface and said substantially planar surface, and through said second opening, and wherein a force applied to said strap in a second direction, opposite the first direction, causes a frictional force to occur, as said engagement surface and said substantially planar surface sandwich said strap to prevent movement of said strap in the second direction.

2. The apparatus according to claim 1, wherein said substantially planar surface is integrally formed on an outer surface of said shoulder pad.

3. The apparatus according to claim 1, wherein said substantially planar surface is rigidly attached to said shoulder pad.

4. The apparatus according to claim 1, wherein said substantially planar surface is attached to said shoulder pad by an attachment devices selected from the group consisting of screws, rivets, bolts/nuts, welds and adhesives.

5. The apparatus according to claim 1, further comprising:

a bulge portion formed adjacent to said substantially planar surface and adjacent to said second opening.

6. The apparatus according to claim 5, wherein said bulge portion causes said strap to lift away from said shoulder pad and to engage an edge of said wedge to push said wedge in the second direction.

7. The apparatus according to claim 1, wherein said strap is non-elastic.

8. The apparatus according to claim 7, wherein said strap is formed of a material selected from the group consist of plastic coated webbing, nylon webbing, leather, metallic plastic coating strapping, and elastomers.

9. The apparatus according to claim 1, wherein said predetermined angle is between three and ten degrees.

10. The apparatus according to claim 9, wherein said predetermined angle is substantially seven degrees.

11. The apparatus according to claim 1, further comprising:

at least one of discontinuities and grooves formed on or in said substantially planar surface for reducing a contact area between said strap and said substantially planar surface.

12. The apparatus according to claim 1, wherein said engagement surface includes projections having a conical shape.

13. The apparatus according to claim 1, wherein said engagement surface includes projections having an angle between 60 and 180 degrees relative to said second surface of said wedge.

14. The apparatus according to claim 13, wherein said projections have an angle of substantially 90 degrees relative to said second surface of said wedge.

15. The apparatus according to claim 1, wherein said engagement surface includes projections which are aligned in rows and columns to form a multi-axis symmetrical distribution.

16. The apparatus according to claim 1, wherein said engagement surface includes projections which are stepped-shaped.

17. The apparatus according to claim 1, wherein said strap is a first strap and further comprising:

a second strap attached to said shoulder pad and to said substantially planar surface, said second strap having a length such that said substantially planar surface overlies said shoulder pad.

18. The apparatus according to claim 1, wherein said strap includes a first end and a second end, said first end being attached to said shoulder pad and said second end being a rolled and stitched end.

19. The apparatus according to claim 1, further comprising:

an attachment device for connecting said housing to said substantially planar surface, said attachment device being selected from the group consisting of screws, rivets, bolts/nuts, welds and adhesives rivets.

20. The apparatus according to claim 1, wherein said handle is attached to said first surface of said wedge, and further comprising:

a slot in said housing, said handle projecting through said slot.

21. An apparatus comprising:

an article of apparel;

a strap attached to said article of apparel;

a substantially planar surface attached to said article of apparel;

a housing overlying said substantially planar surface and forming a first opening between said substantially planar surface and said housing and a second opening between said substantially planar surface and said housing;

a wedge contained within said housing, said wedge including a first surface and a second surface arranged at a predetermined angle relative to one another;

a handle associated with said wedge for allowing said wedge to be manually moved;

an engagement surface formed on said second surface for engaging with said strap, wherein said strap passes through said first opening, between said engagement surface and said substantially planar surface, and through said second opening; and a bulge portion formed adjacent to said substantially planar surface and adjacent to said second opening.

22. The apparatus according to claim 21, wherein said bulge portion causes said strap to lift away from said substantially planar surface and engage an edge of said wedge.

23. The apparatus according to claim 21, wherein said substantially planar surface is integrally formed on said article of apparel.

24. The apparatus according to claim 21, further comprising:

at least one of discontinuities and grooves formed on or in said substantially planar surface for reducing a contact area between said strap and said substantially planar surface.

25. The apparatus according to claim 24, wherein said engagement surface includes projections having a conical shape.

26. The apparatus according to claim 21, wherein said strap is a first strap and further comprising:

a second strap attached to said article of apparel and to said substantially planar surface, such that said second strap attaches said substantially planar surface to said article of apparel.

27. The apparatus according to claim 21, wherein said handle is attached to said first surface of said wedge, and further comprising:

a slot in said housing, said handle projecting through said slot.

28. A strap fastening apparatus integral with an article of apparel comprising:

an article of apparel;

a substantially planar surface;

a wedge having a handle and a surface with a predetermined angle, said wedge further including projections which engage with a strap;

a housing, said wedge being contained within said housing; and an attachment device, said attachment device fastening said housing to said planar surface, said housing and planar surface forming a first opening and a second opening, whereby translational displacement required for locking said wedge and smoothing wear of said wedge are substantially reduced while friction is substantially increased between said wedge and said strap and between said planar surface and said strap, wherein said projections have a conical shape, and wherein the planar surface includes a base plate and the strap is a first strap, the strap fastening apparatus further comprises a second strap attached to said base plate on a side opposite to said housing, a cushion member is attached to said second strap; and said second strap is connected to said article of apparel.

29. The strap fastening apparatus of claim 28, wherein said first strap includes two ends, at least one end having a stitched rolled end.

30. A strap fastening apparatus integral with an article of apparel comprising:

an article of apparel;

a substantially planar surface;

a wedge having a handle and a surface with a predetermined angle, said wedge further including projections which engage with a strap;

a housing, said wedge being contained within said housing; and an attachment device, said attachment device fastening said housing to said planar surface, said housing and planar surface forming a first opening and a second opening, whereby translational displacement required for locking said wedge and smoothing wear of said wedge are substantially reduced while friction is substantially increased between said wedge and said strap and between said planar surface and said strap, wherein the planar surface is disposed on said article of apparel, and further comprising a bulge portion disposed adjacent to said planar surface and adjacent to said second opening.

31. The strap fastening apparatus of claim 30, further comprising a slot in said housing, said handle projecting through said slot.

32. The strap fastening apparatus of claim 31, wherein said article of apparel includes protective shoulder gear.

* * * * *